United States Patent [19]

Rupp et al.

[11] 4,315,780

[45] Feb. 16, 1982

[54] METHOD FOR CLEANING FIREARMS

[75] Inventors: Anthony P. Rupp, Stamford, Conn.; Salvatore Intrieri, Jr., Mount Kisco; Arthur H. Walkley, IV, Bedford Hills, both of N.Y.

[73] Assignee: Belltown, Ltd., Stamford, Conn.

[21] Appl. No.: 174,803

[22] Filed: Aug. 4, 1980

[51] Int. Cl.[3] ..... B08B 7/00

[52] U.S. Cl. ..... 134/7; 134/8; 134/39; 42/1 BC; 51/309; 252/167

[58] Field of Search ..... 134/7, 8, 22 C, 39, 134/36, 22.11, 22.14; 51/290, 400, 306, 309; 42/1 BC; 15/104.16 S; 252/163, 167

[56] References Cited

U.S. PATENT DOCUMENTS

| | | | |
|---|---|---|---|
| 1,497,836 | 6/1924 | Benedict | 252/167 |
| 1,965,299 | 7/1934 | Patterson | 51/306 |
| 2,862,218 | 12/1958 | Krone | 42/1 BC |
| 3,214,867 | 11/1965 | Henning | 134/7 |

*Primary Examiner*—S. Leon Bashore
*Assistant Examiner*—Michael L. Goldman
*Attorney, Agent, or Firm*—Kramer and Brufsky

[57] ABSTRACT

Lead and carbon deposits are removed from the chambers and barrels of firearms by applying thereto a liquid composition having from 45 to 55 weight percent aluminum oxide, from 40 to 50 weight percent of a hydrocarbon oil boiling in the range of about 150 degrees to 350 degrees centigrade, from 3.5 to 4.5 weight percent of lemon oil, and from 0.5 to 1.5 weight percent of ammonium chloride. The liquid composition is impregnated onto a woven web, such as a cotton cloth.

4 Claims, No Drawings

METHOD FOR CLEANING FIREARMS

BACKGROUND OF THE INVENTION

This invention relates to a method of cleaning interior portions of firearms, such as chambers and barrels, and exterior portions, specifically the face of the cylinder. More particularly, it relates to a method for removing lead and carbon deposits from the barrels, chambers, and cylinder face of firearms.

When firearms, such as pistols, rifles and other small arms, are fired, there are frequently deposited within the chambers and barrels thereof minute amounts of lead and carbon. Over a period of time, such carbon and lead deposits build up to the extent that the efficiency and utility of the weapon is significantly decreased and it becomes necessary to remove said carbon and lead deposits. The proper cleaning of firearms is an important factor in keeping them accurate and dependable.

The standard current method is as follows: attach a clean cotton patch dipped in nitro solvent to a cleaning rod. The rod is run back and forth through the barrel (bore) and the cylinders, replacing the patch frequently so as not to transfer the residue from one part of the weapon to another. Next a brass brush of the same calibre as the weapon is attached to the cleaning rod and scrubbed vigorously through the barrel (bore) and the cylinders. This operation is meant to remove the lead and residue build-up from the spent cartridges. The brush recommended for this use is of the same diameter as the bore itself, thus requiring an oversized brush if all of the lead is to be removed. Then, additional clean cotton patches are run through the barrel (bore). This same procedure is to be used in each cylinder of a revolver. A protective oil is then applied. This multi-step method is time-consuming and there is a tendency among firearms users to perform this task somewhat less frequently than would be desirable.

The face of the cylinder on a revolver collects the lead splash-back along with powder burns, thus making this a very difficult area to clean. The amount of lead build-up here will determine what tools and method should be used. If the build-up is heavy, some scraping with a sharp instrument can be used to take off the bulk of the lead, prior to employing the above-described method. In so doing, care should be taken not to mar the finish of the weapon. As previously stated, this is a messy and time consuming operation. Typically, an hour spent on a weapon will not leave it completely lead free.

It is an object of this invention to provide a simpler means for cleaning the interior portions of firearms, a method which involves fewer steps and is less time-consuming.

DETAILED DISCLOSURE

The present invention provides a method of cleaning the interior portions of firearms by applying thereto a liquid composition comprising from about 45 to about 55 weight percent of aluminum oxide, from about 40 to about 50 weight percent of hydrocarbon oil boiling in the range of about 150 degrees to about 350 degrees centigrade, from about 3.5 to about 4.5 weight percent of lemon oil, and from about 0.5 to about 1.5 weight percent of ammonium chloride. The affected areas are treated with an absorbent material impregnated with said liquid composition. When treated in this manner, lead and carbon deposits can be removed from interior portions of firearms in an essentially one-step process.

In the liquid composition useable in the method of this invention, the aluminum oxide, which functions as an abrasive, should be present in an amount ranging from about 45 to about 55 weight percent of the composition. Conveniently, the aluminum oxide can be present in about 50 weight percent.

The hydrocarbon oil forms a protective film over the treated surface and is an essential ingredient in the method of this invention. The oil seeps into the tiny pores of the metal and provides a protective film. It also acts as a carrier for the aluminum oxide and ammonium chloride ingredients. Any hydrocarbon oil boiling the range of from about 150 degrees to about 350 degrees centigrade can be employed in the method of this invention; examples of such oils are kerosene, Number 1 fuel oil, Number 2 fuel oil, etc. From the standpoint of economics and availability, Number 2 fuel oil is particularly suited. The hydrocarbon oil should be present in an amount ranging from about 40 to about 50 weight percent of the liquid composition, preferably about 45 weight percent.

The third ingredient present in the composition for use in our method is lemon oil. This ingredient, which should be present in an amount ranging from about 3.5 to about 4.5 weight percent, preferably about 4 weight percent, serves a dual function. Like the hydrocarbon oil, the lemon oil functions as a film-former and carrier. Its second function is to provide a more agreeable fragrance to the composition.

The fourth ingredient is ammonium chloride, present in an amount ranging from about 0.5 to about 1.5 weight percent, preferably about 1 weight percent. Although this ingredient is present in only a small amount, its presence in the composition is essential. While not wishing to be bound by any particular theory, it is believed that the ammonium chloride may form a weakly bonded chemical complex with lead and may have some electrostatic attraction for carbon particles, particularly when the composition is applied by rubbing with an impregnated cloth.

As stated above, the liquid composition useable in the practice of this invention is applied to the surfaces to be treated by means of an impregnated absorbent web. Preferably, the absorbent web is a cloth consisting of or comprising principally, cotton. The composition of the cloth is not believed to be essential, so long as the cloth has the necessary absorbency for the liquid composition. Typically, a cotton cloth impregnated with the liquid composition will have the following amounts of the individual ingredients per square inch:

aluminum oxide: 0.03–0.10 grams
hydrocarbon oil: 0.03–0.09 grams
lemon oil: 0.003–0.008 grams
ammonium chloride: 0.0004–0.0012 grams The foregoing ranges are illustrative only. The amounts of specific ingredients can be beyond these maxima and minima, so long as they are present within the proportions set forth above.

Cloths impregnated with aluminum oxide, hydrocarbon oils, lemon oil and/or ammonium chloride have been used as cleaning and polishing agents for silver, pewter, gold, chrome, steel, aluminum and brass, and also for various stain and spot removers, and for removal of rust and corrosion. However, compositions such as those useable in the method of the instant invention or compositions containing the same ingredients in other proportions have not heretofore been employed in the cleaning of firearm barrels, chambers, or cylinder faces.

This invention will be better understood by reference to the following examples, which are included here for the purposes of illustration and are not to be construed as limitations.

EXAMPLE 1

A liquid composition (200 grams) was prepared by admixing the following substances: aluminum oxide—100 grams; Number 2 fuel oil—90 grams; lemon oil—8 grams; and ammonium chloride—2 grams. The composition was impregnated in a cotton cloth which was weighed before and after impregnation. Analysis of the cotton cloth after impregnation showed the following amounts of ingredients: aluminum oxide—0.0656 grams per square inch; Number 2 fuel oil—0.0594 grams per square inch; lemon oil—0.0056 grams per square inch; and ammonium chloride—0.0008 grams per square inch.

These cloths were used in the following example.

A ½"×½" patch of impregnated cloth prepared according to Example 1 was wrapped around a brass brush of the same calibre as a revolver to be cleaned. The wrapped brush was pushed back and forth through the barrel (bore) and each cylinder. Then, clean cotton patches are run through the barrel and cylinders. The base of the cylinder was cleaned by simply wiping it with an impregnated cloth patch according to Example 1. The impregnated cloth removes lead and powder burns without harming the weapon's finish.

Following the foregoing procedure after each use of the revolver keeps it free of lead and carbon deposits.

What is claimed as new is:

1. A method for removing lead and carbon deposits from the interior portions and cylinder faces of firearms which comprises applying thereto a liquid composition impregnated into an absorbent web, said composition consisting essentially of from about 45 to about 55 weight percent of aluminum oxide, from about 40 to about 50 weight percent of a hydrocarbon oil boiling in the range of about 150 degrees to 350 degrees centigrade, from about 3.5 to about 4.5 weight percent of lemon oil, and from 0.5 to about 1.5 weight percent of ammonium chloride.

2. A method according to claim 1 in which the hydrocarbon oil is Number 2 fuel oil.

3. A method according to claims 1 or 2 in which the abosrbent web is a cotton cloth.

4. A method according to claim 1 in which barrels and chambers of firearms are treated.

* * * * *